US010357086B2

(12) United States Patent
Jarrell et al.

(10) Patent No.: US 10,357,086 B2
(45) Date of Patent: Jul. 23, 2019

(54) COLLAPSIBLE RETAINING STRUCTURE FOR BODY PIERCING JEWELRY

(71) Applicant: Kaos Softwear, LLC, Portland, OR (US)

(72) Inventors: Jesse Jarrell, Portland, OR (US); Steve A. Haworth, Gilbert, AZ (US)

(73) Assignee: Kaos Softwear, LLC, Portland, OR (US)

( * ) Notice: Subject to any disclaimer, the term of this patent is extended or adjusted under 35 U.S.C. 154(b) by 0 days.

(21) Appl. No.: 15/869,728

(22) Filed: Jan. 12, 2018

(65) Prior Publication Data

US 2018/0132578 A1 May 17, 2018

Related U.S. Application Data

(63) Continuation-in-part of application No. 14/684,876, filed on Apr. 13, 2015, now Pat. No. 9,936,776, which is a continuation of application No. 13/344,082, filed on Jan. 5, 2012, now Pat. No. 9,021,834.

(51) Int. Cl.

| | |
|---|---|
| ***A44C 7/00*** | (2006.01) |
| ***A44C 15/00*** | (2006.01) |
| *A44C 17/02* | (2006.01) |

(52) U.S. Cl.

CPC ..... *A44C 7/003* (2013.01); *A44C 15/0035* (2013.01); *A44C 17/0208* (2013.01); *Y10T 24/41* (2015.01)

(58) Field of Classification Search

CPC . A44C 15/0035; A44C 15/00; A44C 15/0045; A44C 15/0095; A44C 7/003; A61B 5/6816; Y10S 24/91; Y10S 63/03; F16B 13/045; F16B 13/04

USPC ..... 63/13; 24/453, 705

See application file for complete search history.

(56) References Cited

U.S. PATENT DOCUMENTS

| | | | |
|---|---|---|---|
| 229,080 | A | 6/1880 | Ballou |
| 2,990,988 | A | 7/1961 | Ziegenbein |
| 3,093,027 | A | 6/1963 | Rapata |
| 3,621,751 | A | 11/1971 | Fiorentino |
| 3,805,439 | A | 4/1974 | Krengel et al. |
| 4,129,998 | A | 12/1978 | Ferro |
| 5,076,072 | A | 12/1991 | Payne |

FOREIGN PATENT DOCUMENTS

JP 2013085699 A * 5/2013

* cited by examiner

*Primary Examiner* — Jack W Lavinder
(74) *Attorney, Agent, or Firm* — Chernoff Vilhauer LLP

(57) ABSTRACT

Flexible retaining structures for body jewelry and method for their use. A loop portion may be open and present a width greater than a cross-section of a shaft-like transdermal portion and the loop may be oriented at an angle to the transdermal shaft-like portion when the retaining structure is in a relaxed condition. The structure may be stretched to close the loop and reduce the cross-sectional area of the loop portion of the retaining structure.

5 Claims, 6 Drawing Sheets

COLLAPSIBLE RETAINING STRUCTURE FOR BODY PIERCING JEWELRY

BACKGROUND

The present invention relates generally to body jewelry and more specifically to collapsible retaining structures for body piercing jewelry that are soft and/or flexible enough to be easily compressed. In this way the retainer can easily pass through the same piercing canal that it retains the jewelry within, and will securely hold a cylindrical transdermal portion of jewelry within the piercing canal.

It can be appreciated that body jewelry has been in use for years. Typically, body jewelry is comprised of machined surgical steel, titanium, and/or gold; glass forms, carved stone, bone and/or wood; or molded and/or machined polymers of various consistencies. Such jewelry is typically inserted into piercing canals, which are holes passing through the skin of a wearer. In order to be retained in the piercing canal, the jewelry must either have a shape that requires manipulation in several directions for removal (such as the bent wire hooks common on earrings), have an openable hoop or ring that can be closed after insertion, or be sized such that some part of the body jewelry is larger than the piercing canal, and cannot pass easily through.

The main problem with the third type described above is that most body jewelry of this type is comprised of at least two separable parts. One or more end caps, beads, or O-rings must be removed to allow the jewelry to be inserted into a piercing, and then replaced to retain the jewelry in the piercing. These extra retaining bodies are easily lost and sometimes difficult to operate. Other jewelry designs may instead utilize a rigid enlarged rim to hold the jewelry in place, but this rim must be forced through the smaller piercing canal, and this often results in pain for the user. Another problem with conventional body jewelry is that, when worn, most jewelry designs can be caught and entangled by other objects or outside forces, and if forced from the piercing can severely damage or destroy the piercing canal in which it was seated. Another problem with conventional body jewelry is that when a piercing that contains jewelry with rigid retaining elements becomes infected or inflamed, the retaining bodies may become embedded in the swollen tissue around the piercing, or even forced into the piercing canal itself by the expansion of swelling tissue around the jewelry, causing further damage to an already irritated piercing.

SUMMARY

In view of the disadvantages inherent in prior art body jewelry, the present invention provides collapsible retaining structures which are soft and/or flexible enough to be easily compressed or reshaped temporarily with appropriate force, so that the retaining structure can easily pass through the piercing canal, and will resume a relaxed configuration thereafter to securely hold the transdermal portion of jewelry in that canal.

To attain this, the present invention generally comprises a collapsible retaining body connected to a transdermal portion of a piece of piercing jewelry, the latter lying within a piercing canal. The retaining body is soft and/or flexible enough to be stretched such that its cross-section contracts to allow it to pass through a piercing canal, and the retaining body can then return to its original configuration once it is beyond the canal, to keep the jewelry in place.

The foregoing and other objectives, features, and advantages of the invention will be more readily understood upon consideration of the following detailed description of the invention taken in conjunction with the accompanying drawings.

BRIEF DESCRIPTION OF THE SEVERAL DRAWINGS

DETAILED DESCRIPTION

The attached figures illustrate various systems of collapsible retaining structures for body jewelry, which comprises a collapsible retaining body that is soft and/or flexible enough to be stretched such that its cross-section contracts to allow it to pass through a piercing canal.

For the purposes of this application, "cross-section" refers to the diameter of the smallest circle which encloses all parts of a jewelry retaining structure at a given point. The circle meant is drawn in a plane perpendicular to an axis defined by the transdermal portion as it is intended to pass through the piercing canal.

Figure 1A:
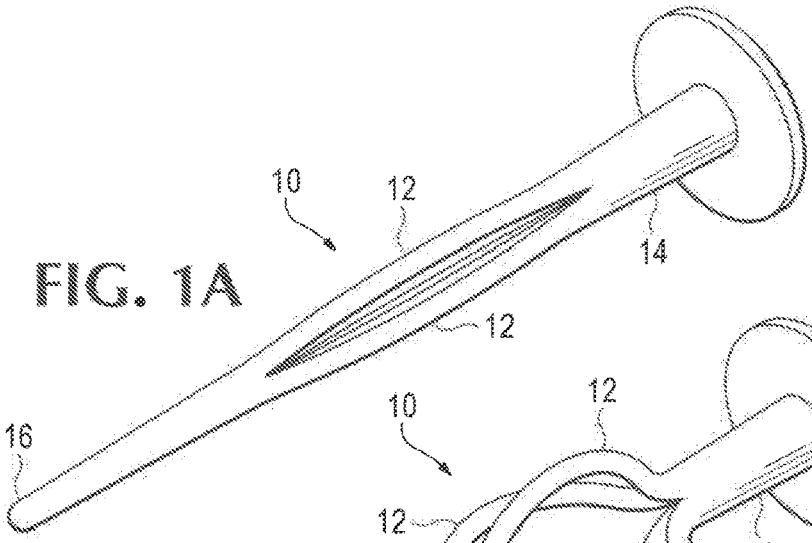
FIG. 1A shows one embodiment of a jewelry retaining structure in the form of a web, depicted in its stretched or insertable configuration, as when a user pulls on it.
Figure 1B:
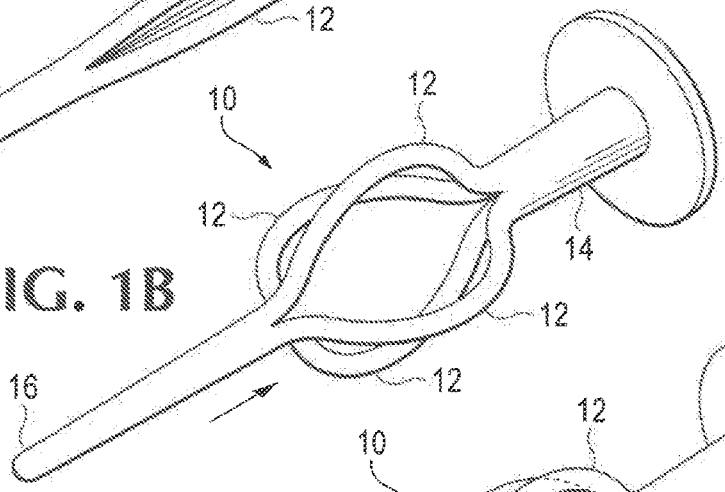
FIG. 1B shows the jewelry retaining structure of FIG. 1A in its relaxed or retaining configuration, to which it returns when tension is released.
Figure 1C:
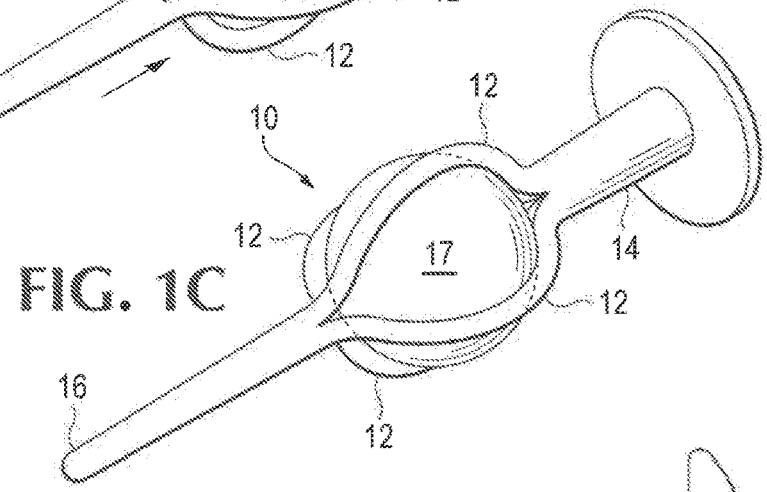
FIG. 1C shows the jewelry retaining structure of FIG. 1A with a rigid object inserted into the web to lock it in its expanded configuration.

FIGS. 1A-C show a retaining body 10 made of a flexible polymer having a cage structure. Filaments 12 deviate outward from the cylindrical transdermal portion 14 of the jewelry, such that the structure naturally has a cross-section larger than that of the transdermal portion 14. The filaments 12 of the retaining body 10 recombine into a tapering leader 16. At least three such filaments 12 are necessary to form the cage structure. The end of the leader 16 may be passed into the piercing canal, grasped from the opposite side, and pulled so that the retaining body 10 is stretched to a flattened state as shown in FIG. 1A, allowing it to pass easily through the piercing canal. When released the retaining body 10 will expand and return to its original form as shown in FIG. 1B. It may be locked in this shape by insertion of a separate rigid locking object 17 of appropriate size and shape (see FIG. 1C).

Figure 2A:
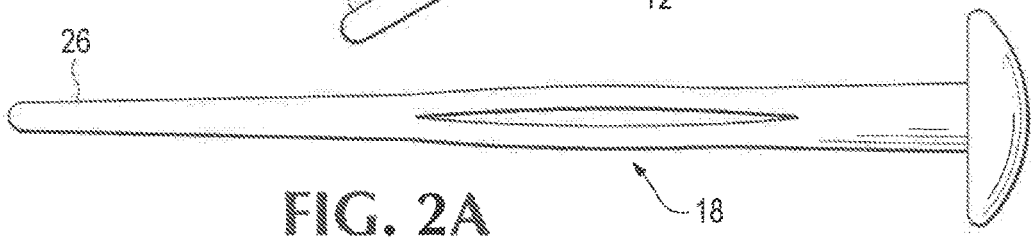
FIG. 2A shows an alternate embodiment of a jewelry retaining structure consisting of a simple loop, in its stretched or insertable configuration, as when a user pulls on it.
Figure 2B:
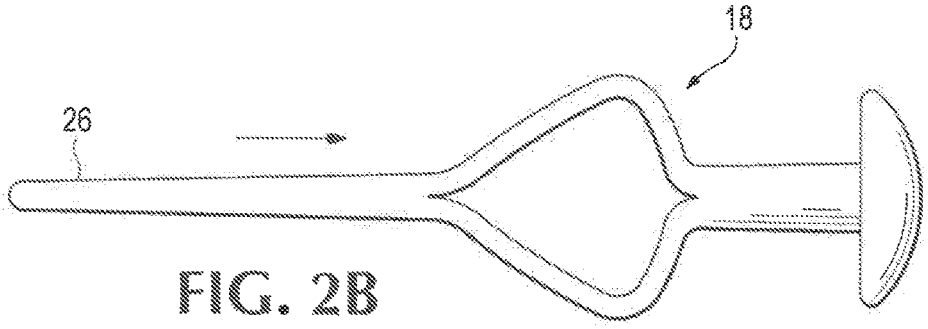
FIG. 2B shows the jewelry retaining structure of FIG. 2A in its relaxed or retaining configuration, to which it returns when tension is released.
Figure 2C:
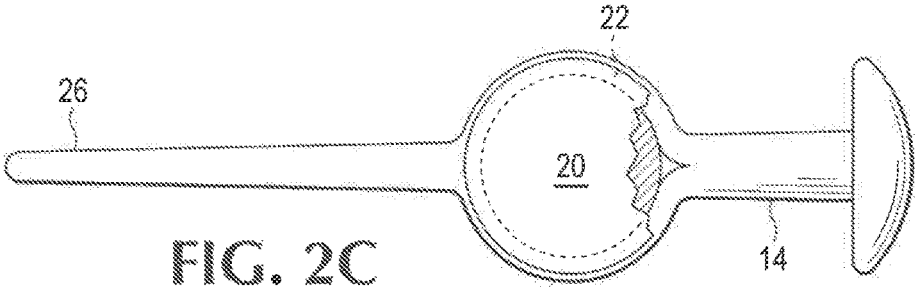
FIG. 2C shows the jewelry retaining structure of FIG. 2A with a rigid object inserted into the loop to lock it in its expanded configuration.
Figure 2D:
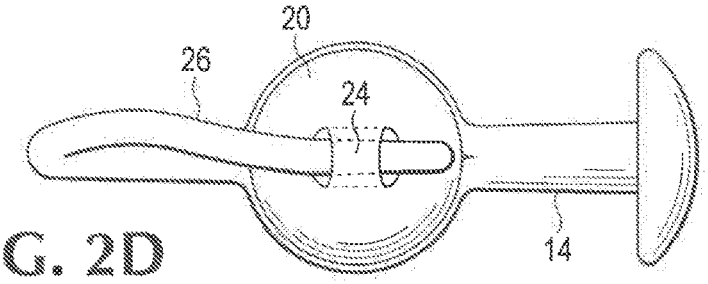
FIG. 2D shows the jewelry retaining structure of FIG. 2A with a rigid object inserted into the loop to lock it in its expanded configuration and the leader tucked into an opening in the rigid object.

In FIGS. 2A-D, the retaining body is a simple single loop 18 that can be stretched near flatness as shown in FIG. 2A. Single loop 18 may have a separate rigid locking object 20 inserted within it for decoration or to hold the loop 18 in its retaining state as shown in FIG. 2C. This rigid locking object 20 may have grooves 22 in which the loop 18 may lie once inserted, or the rigid locking object 20 may be maintained within the loop 18 only by tension. The rigid locking object 20 may also include a small hole or a groove 24 that the leader 26 could be tucked into when the jewelry is worn as shown in FIG. 2D.

Figure 3B:
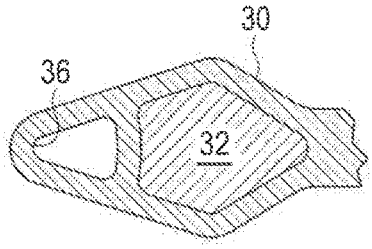
FIG. 3B shows a cross-section through the middle of the jewelry retaining structure shown in FIG. 3A, showing the hollow center.
Figure 3A:
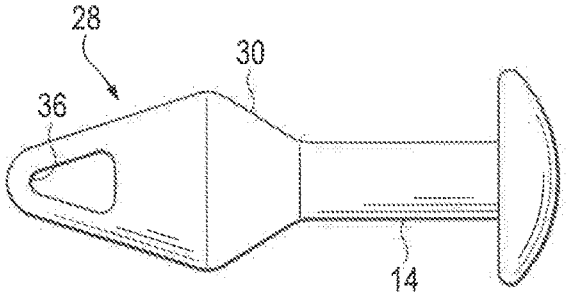
FIG. 3A shows an alternate embodiment of a jewelry retaining structure in the form of a hollow shell with a hook-eye.
Figure 3C:
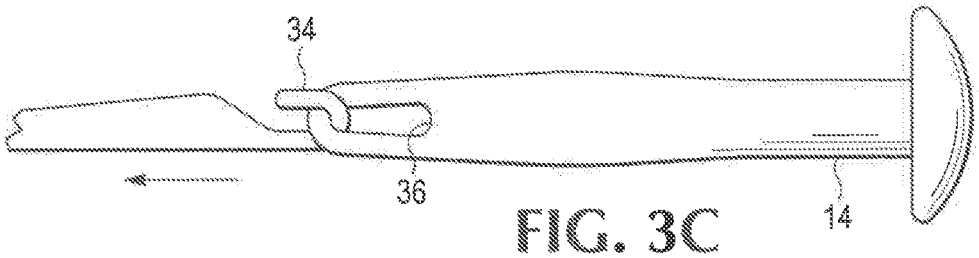
FIG. 3C shows a hook being used to stretch the jewelry retaining structure shown in FIG. 3A into its stretched or insertable configuration.

FIGS. 3A-C show a flexible polymer retaining body 28 that is neither a loop nor cage-like structure, but has a hollow shell 30 surrounding an interior 32 which is filled either with air or another compressible or easily displaced, soft, material. Such an interior 32 would allow the retaining body 28 to be compressed into a narrowed state as shown in FIG. 3C by utilizing a detachable hook 34 as a leader, by temporarily attaching the hook 34 to the hook-eye 36, and passing the hook 34 through the piercing canal to stretch the retaining body 28. Such a hollow shell design could alternately utilize a long tapering leader similar to that shown in FIG. 2. Other designs for a detachable leader are also possible.

Figure 4:
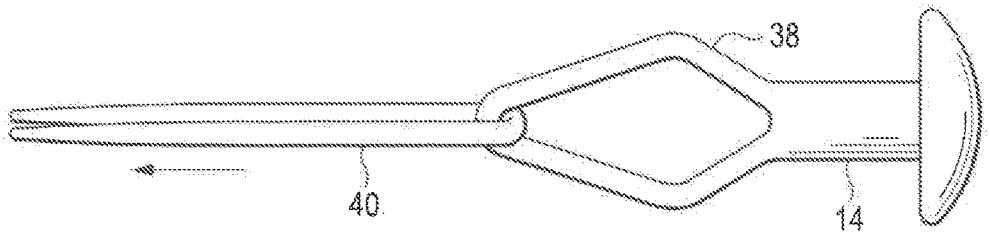
FIG. 4 shows an alternative embodiment of a jewelry retaining structure in the form of a leaderless loop, with a thin leader formed of a folded tapering cylinder temporarily inserted to stretch the structure into an insertable configuration.

FIG. 4 depicts another embodiment. A hook-eye 36 could be substituted by a simple loop 38 without any leader extending from the transdermal portion 14 of the jewelry. Such a loop 38 or any opening found in the retaining body could be inserted using the hook 34 as a leader. Alternatively, a detachable thin cylinder 40 of flexible polymer that is tapered at both ends can be folded through a loop 38 or hook-eye 36 to serve as the leader for stretching and insertion.

Referring now to FIGS. 5-11, a further alternative jewelry retaining structure 110 may be made of a flexible, elastic, polymer material that may be similar to that of the retraining retaining structure 10 shown in FIGS. 1-4. The retaining structure 110 has a relaxed configuration as shown in FIGS. 5-9, in which a retainer portion 112, including a loop 114, is oriented at a selected angle 115 such as, for instance, 90° to a central axis 116 of a main shaft-like transdermal portion 118. Thus, when the retaining structure 110 is free from outside forces the loop 114 is located substantially in a plane perpendicular to the central axis 116, so that it prevents withdrawal from a piercing canal through which the transdermal portion 118 extends. The loop 114 has a pair of opposite slender sides 120 that, when relaxed, diverge from each other at the inner end 122 of the transdermal portion 118, and then curve around and converge with each other at a small distance from the inner end 122, forming a tapered slender leader 124, with a cross-section no greater than that of the transdermal portion 118, at a side of the loop 114 opposite the origin of the loop at the inner end 122 of the transdermal portion 118.

As a result of its elasticity and flexibility, the jewelry retaining structure 110 may easily be straightened when the leader 124 is grasped and pulled as required to align the leader 124 with the central axis 116. By applying sufficient tension between the leader 120 and the base 126 of the transdermal portion, the loop 114 can be elongated, eventually bringing the two opposite sides 120 alongside each other, placing the jewelry retaining structure 110 in the configuration shown in FIGS. 10 and 11. Thus, when the jewelry retaining structure 110 is placed in tension its configuration will be similar to the configuration of the jewelry retaining structure 10 as shown in FIG. 2B.

As with the jewelry retaining structure 10 shown in FIG. 1 and discussed above, once the jewelry retaining structure 110 has been placed under sufficient tension, its cross-section is reduced, and the leader 124 can be passed through the piercing canal, and with the jewelry retaining structure 110 held with the sides 120 of the loop 114 kept together, the cross-section of the jewelry retaining structure 110, including the retainer portion 112, shrinks to be no greater than that of the shaft-like transdermal portion 118, and the retainer portion 112 can pass easily through the piercing canal.

It will be understood that the jewelry retaining structure 110 could incorporate the filaments 12 of the retaining body 10 oriented at an angle to the central axis 116 of the transdermal portion 118, instead of the loop 114. Similarly, the retaining structure 110 could incorporate a hollow shell 30 oriented at an angle to the central axis of the transdermal portion 118.

Figure 5:
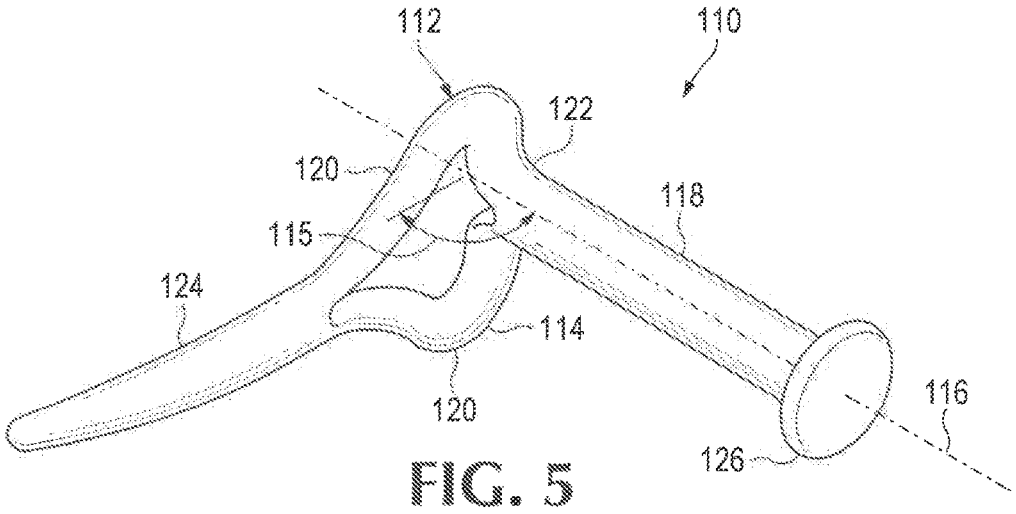
FIG. 5 is an isometric view from near one end of a shaft-like transdermal portion of an alternative embodiment of a jewelry retaining structure having a retaining loop oriented at an angle to the transdermal portion, with the jewelry retaining structure shown in a relaxed condition.
Figure 6:
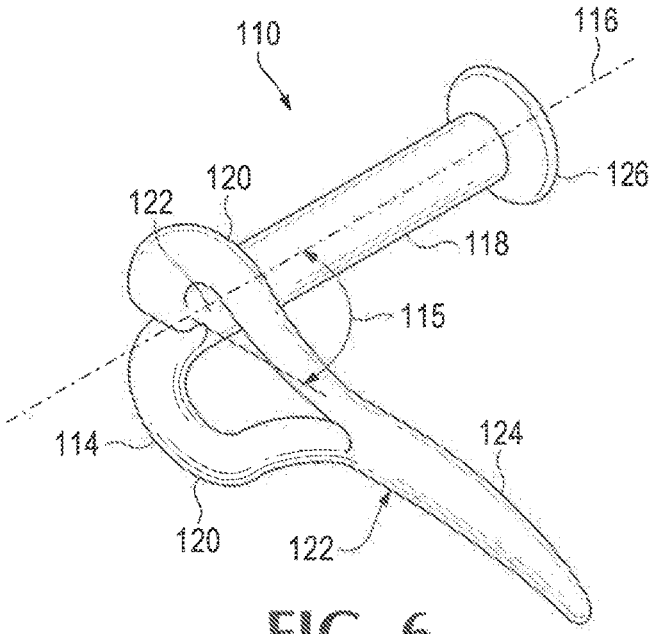
FIG. 6 is an isometric view of the jewelry retaining structure shown in FIG. 5, as seen from near an opposite end of the shaft-like transdermal portion
Figure 9:
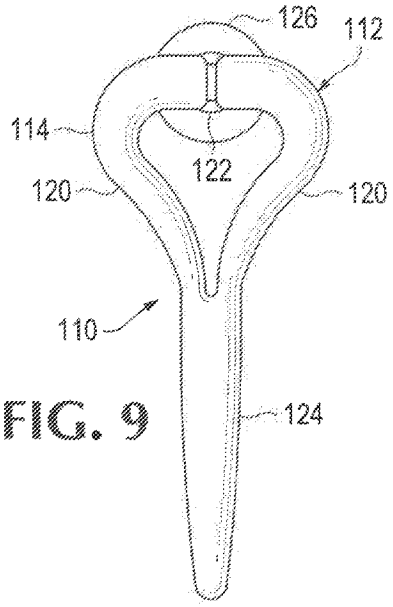
FIG. 9 is an inner, or retainer, end view of the jewelry retaining structure shown in FIGS. 5-8.
Figure 8:
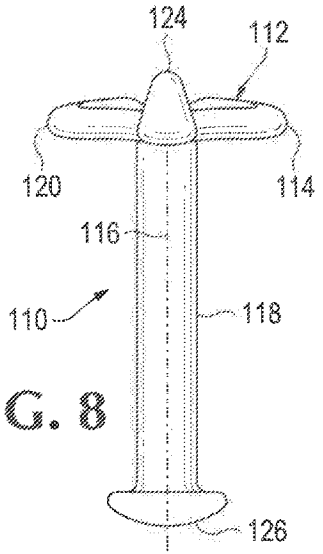
FIG. 8 is a front elevational view of the jewelry retaining structure shown in FIGS. 5-7.
Figure 7:
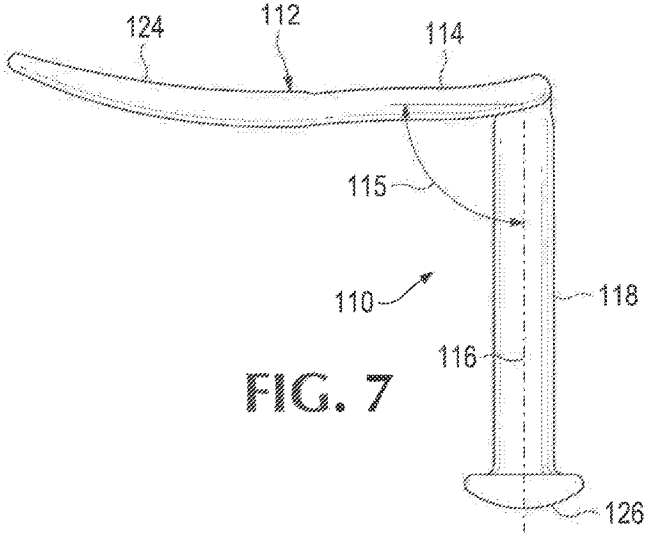
FIG. 7 is a side elevational view of the jewelry retaining structure shown in FIGS. 5 and 6.
Figure 10:
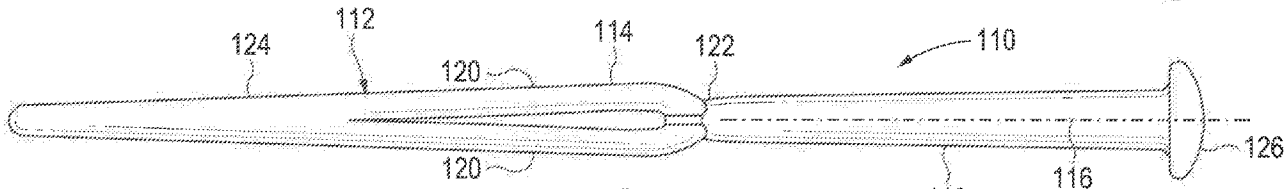
FIG. 10 is a view of the jewelry retaining structure shown in FIGS. 5-9, in a stretched, straightened, configuration, viewed in the direction indicated by the line 10-10 in FIG. 7.
Figure 11:
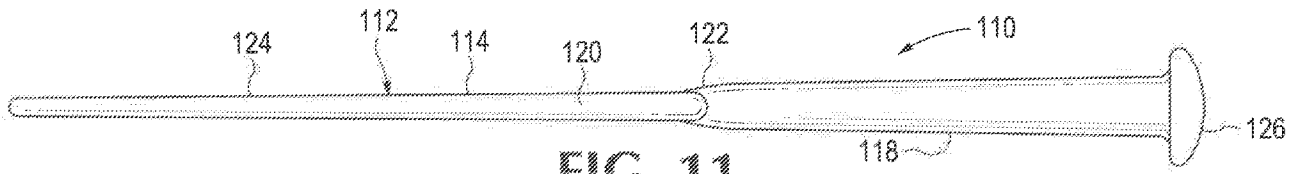
FIG. 11 is a side view of the jewelry retaining structure shown in FIG. 10, in the stretched, straightened, configuration shown in FIG. 10.

Once the retainer portion 112 has been moved through the piercing canal, when the tension on the jewelry retaining structure 110 is relaxed the loop 114 elastically reverts to the open shape shown in FIGS. 5, 6, and 9, and reorients itself perpendicular to the central axis 116 of the shaft-like transdermal portion 118. In most, if not all, cases, this results in the loop 114 and the leader 124 lying comfortably alongside the skin at the inner side of a wearer's ear lobe, lip, etc., through which a piercing canal extends and through which the jewelry retaining structure 110 has been mounted.

Figure 12:
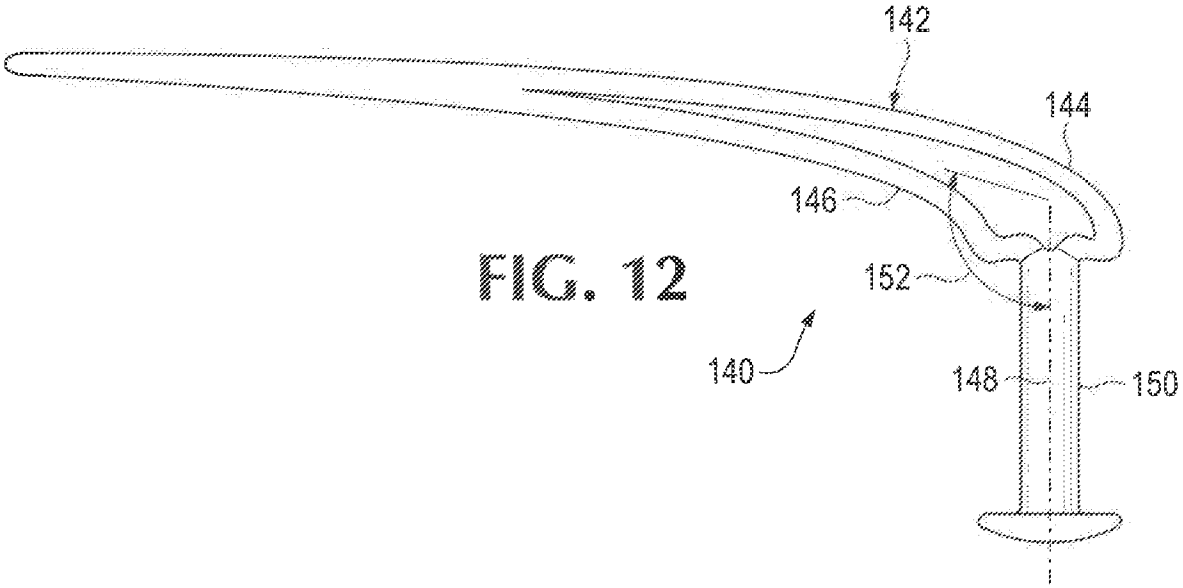
FIG. 12 is a side elevational view, similar to FIG. 7, showing a jewelry retaining structure which is another embodiment of the device disclosed herein.
Figure 13:
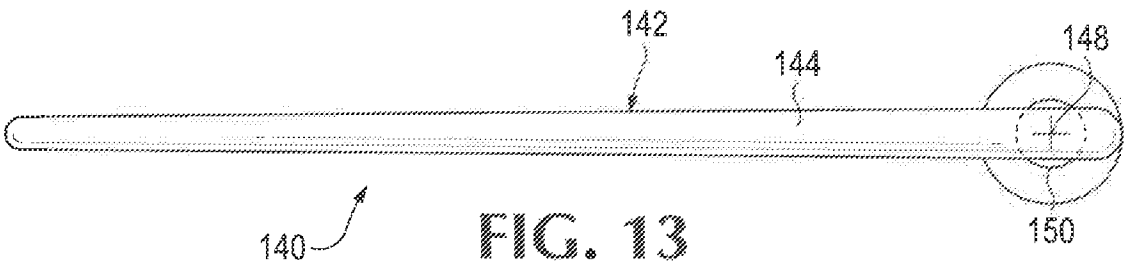
FIG. 13 is an inner, or retainer, end view of the jewelry retaining structure shown in FIG. 12.
Figure 14A:
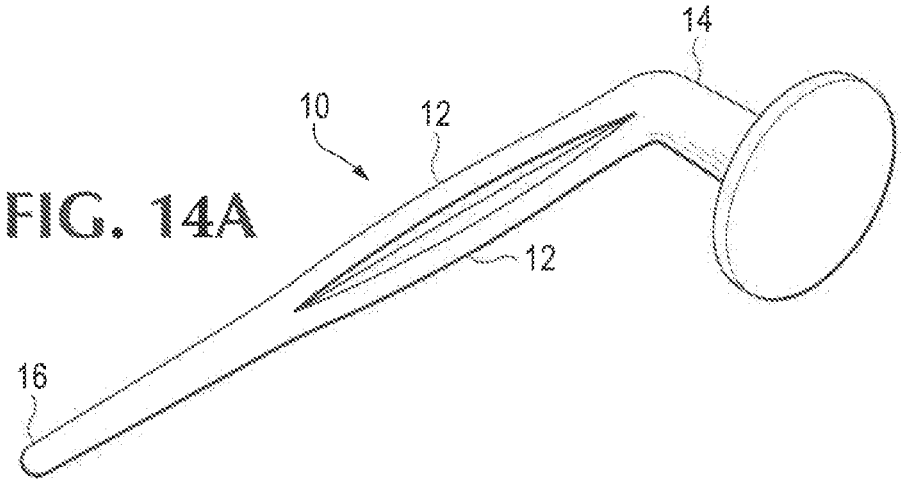
FIG. 14A shows one embodiment of a jewelry retaining structure in the form of a 3-filament web with the retainer portion is oriented at approximately a right angle to the central axis, depicted in its stretched or insertable configuration, as when a user pulls on it.
Figure 14B:
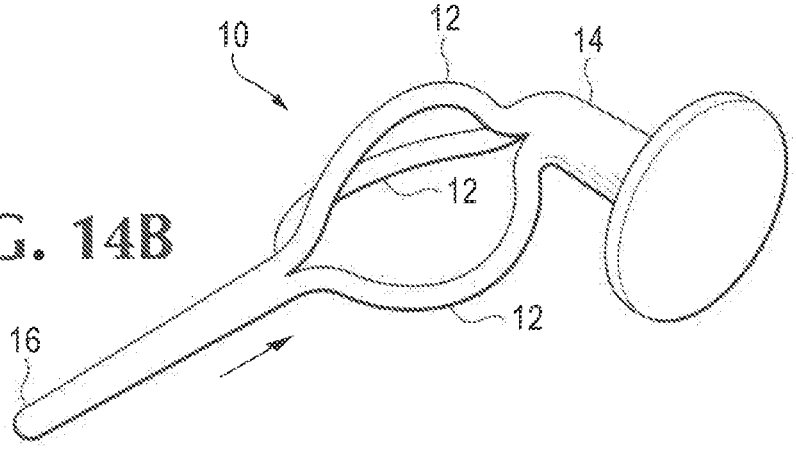
FIG. 14B shows the jewelry retaining structure of FIG. 14A in its relaxed or retaining configuration, to which it returns when tension is released.
Figure 14C:
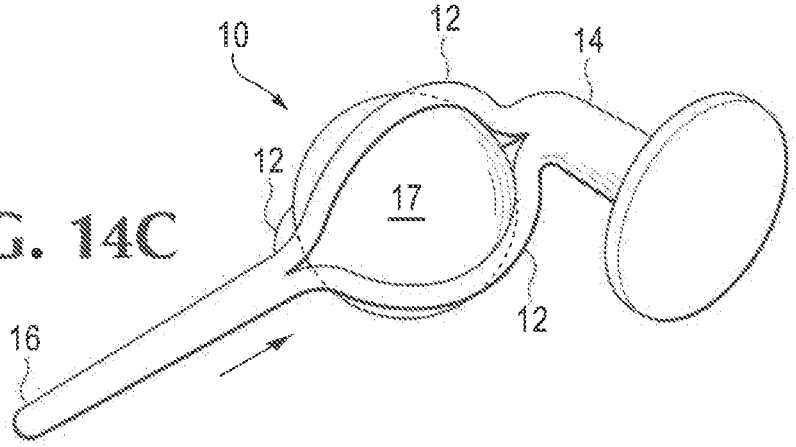
FIG. 14C shows the jewelry retaining structure of FIG. 14A with a rigid object inserted into the web to lock it in its expanded configuration.

A jewelry retaining structure 140, shown in FIGS. 12 and 13, is another embodiment of the concept of including a retainer portion extending at a non-straight angle to the central axis of the transdermal portion of the structure. The jewelry retaining structure 140 may include a loop 142 whose opposite members 144 and 146 are in the same plane as the central axis 148 of the transdermal portion 150 and extend at an angle 152 relative to the central axis 148 when the jewelry retaining structure 140 is in its relaxed condition. As in the jewelry retaining structure 110, when the jewelry retaining structure 140 is placed into tension the members 144 and 146 of the loop can be made to extend in generally the same direction as the central axis 148 of the transdermal portion 150, and the loop 142 can be reduced in width to fit within the cross-section of the transdermal portion 150 and thus can easily pass through the piercing canal.

The size of the jewelry retaining structure 110 or 140 can be chosen as desired for mounting an item of jewelry in a particular place, such as the wearer's ear, lip, or nose. Thus, the shaft-like transdermal portions 114 and 150 may have a diameter equivalent to that of 14-gauge wire or 18-gauge wire and may have a length as appropriate for the application, such as ¼ inch, 5⁄16 inch, ⅜ inch, or more. The head of the transdermal portion 118 or the head of the transdermal portion 148 may have a diameter about twice that of the respective transdermal portion, for example.

In addition to the loops, hollow shapes, and cages shown here, collapsible retaining bodies could be designed as flexible and elastic structures of various complexities embodying the mechanical characteristics described above. These structures may vary in rigidity throughout their geometry to accommodate the mechanical function of a given part of the jewelry retaining structure, or the entire item may be of a single consistency. The retaining body may be detachably mounted or it may be an integral part of the jewelry.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A unitary device for mounting an article of jewelry, comprising:

a transdermal portion having a cross-section and a central axis;

a retainer portion attached to the transdermal portion, the retainer portion when free from outside forces is located substantially in a plane perpendicular to the central axis, and that, when free from outside forces, has a larger cross section than the transdermal portion, said retainer portion being elastically deformable by distally applied tension to reduce the cross-section of the retainer portion to approximately the same as or smaller than the cross-section of the transdermal portion; wherein the retainer portion is oriented at approximately a right angle to the central axis; and a leader having a cross-section no larger than the cross-section of said transdermal portion.

2. The device of claim 1 wherein the retainer portion includes a loop defining a plane approximately perpendicular to the central axis.

3. The device of claim 1 wherein the retainer portion includes a loop defining a plane including the central axis.

4. The device of claim 1 wherein the retainer portion comprises a hollow shell.

5. The device of claim 1 wherein the retainer portion comprises at least three filaments forming a cage.

* * * * *